US007832485B2

(12) United States Patent
Pessin et al.

(10) Patent No.: US 7,832,485 B2
(45) Date of Patent: Nov. 16, 2010

(54) RISERLESS DEPLOYMENT SYSTEM

(75) Inventors: Jean-Louis Pessin, Houston, TX (US); Rod Shampine, Houston, TX (US); Joseph K. Flowers, Houston, TX (US); Vishal Saheta, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 140 days.

(21) Appl. No.: 11/967,562

(22) Filed: Dec. 31, 2007

(65) Prior Publication Data

US 2008/0302542 A1 Dec. 11, 2008

Related U.S. Application Data

(60) Provisional application No. 60/942,803, filed on Jun. 8, 2007.

(51) Int. Cl.
*E21B 34/06* (2006.01)

(52) U.S. Cl. ..... 166/373; 166/380

(58) Field of Classification Search ..... 166/373, 166/376, 378, 379, 380
See application file for complete search history.

(56) References Cited

U.S. PATENT DOCUMENTS 4,372,378 A * 2/1983 Powers, Jr. ..... 166/57
4,844,165 A 7/1989 Van Der Steeg
5,810,087 A * 9/1998 Patel ..... 166/373
5,875,848 A 3/1999 Wolff
6,209,652 B1 4/2001 Portman
6,776,230 B2 8/2004 Collie et al.
7,255,173 B2 * 8/2007 Hosie et al. ..... 166/332.8
7,350,590 B2 * 4/2008 Hosie et al. ..... 166/386
7,451,809 B2 * 11/2008 Noske et al. ..... 166/66
7,475,732 B2 * 1/2009 Hosie et al. ..... 166/373
2004/0084189 A1 * 5/2004 Hosie et al. ..... 166/386
2004/0200614 A1 * 10/2004 Stjernstrom et al. .... 166/250.08
2007/0272414 A1 11/2007 Palmer et al.
2008/0302524 A1 * 12/2008 Hosie et al. ..... 166/66.6
2009/0145610 A1 * 6/2009 Varkey et al. ..... 166/335

* cited by examiner

*Primary Examiner*—William P Neuder
(74) *Attorney, Agent, or Firm*—Michael Dae; David Cate; Robin Nava

(57) ABSTRACT

A method of deploying a tool into a pressurized well is provided that includes providing the well with a wellhead having a blow out preventer coupled thereto; setting a pressure barrier within the well at a distance below the blow out preventer that is at least as long as the length of the tool to create a pressure chamber between the blow out preventer and the pressure barrier; and opening the blow out preventer to allow for conveyance of the tool into the pressure chamber.

29 Claims, 1 Drawing Sheet

RISERLESS DEPLOYMENT SYSTEM

CROSS-REFERENCE TO RELATED APPLICATION

This application claims priority to and the benefit of, under 35 U.S.C. §119(e), U.S. Provisional Application Ser. No. 60/942,803 filed on Jun. 8, 2007, which is incorporated herein by reference.

FIELD OF THE INVENTION

The present invention relates generally to riserless deployment systems for deploying a tool into a pressurized well.

BACKGROUND

In the course of constructing and maintaining oil and gas wells it is often necessary to convey various types of tools into the well. Many types of conveyance are commonly used as are many types of tools. The most common types of conveyance, in order of increasing cost and decreasing speed of conveyance are: slickline, wireline, coiled tubing, snubbing units, workover rigs, and drilling rigs. The tools used on wells range from very short (under one foot) to arbitrary lengths only limited by the method of putting them in the hole (as high as 3000 feet).

In many cases the well does not have any wellhead pressure when the tools are placed in the well. This type of operation is very quick and simple and the tools are typically supported by slips, a gripping band (also known as a wedding band) or by a C-plate. Slips consists of a set of segments with an external taper and an internal diameter close to the diameter of the tool section. These are placed in a matching tapered slip bowl. The taper combined with the weight of the tool causes them to move inward and grip the tool. With the proper combination of gripping surfaces and tapers the tool will be held reliably. A wedding band has a set of segments that can conform to the outside of the tool and a mechanism to tighten them circumferentially around it. With the correct combination of gripping surfaces and adequate tension in the band, the tool will be held reliably. A C-plate is a large washer with a slot cut through it matching the inside hole. This is slid around the tool and a shoulder on the tool bears on the washer. A keeper is often provided to prevent the tool from moving off of the center line of the C-plate. Once the tool is inside the well, the conveyance system is attached to it and the tool is run into the well.

For wells that have well head pressure, some method of getting the tools connected to the conveyance method and inside the pressure barrier is required. In order of decreasing frequency and increasing difficulty, the current methods are: direct riser deployment, indirect riser deployment, and pressurized connection.

In the first method, a riser is assembled that can contain the entire tool string. In no particular order the riser is assembled, the tool is installed in the riser, and the conveyance method is connected to the tool. Once everything is assembled and attached to the BOPs and the well head, the equipment is pressure and pull tested. Then, the riser pressure is equalized with the well and the well head valves are opened. The tool is then run into the well. The procedure is reversed at the end of the job. This method is quite efficient for short tool strings and for longer tool strings with low force conveyance methods (wireline and slickline) that do not require heavy equipment at the top of the riser. As riser lengths increase and heavy equipment is installed on the top of the riser, this method becomes difficult and dangerous.

The second method splits the tool string into at least two pieces, which may have very different lengths. A riser is used to contain the first tool section. The top of the tool section is provided with a deployment bar with an outside diameter that matches the gripping and sealing diameters of at least one BOP (two may be used at high pressures) and has a connector on the top of it that can be disconnected. Some means must be provided to prevent any well bore fluids from coming through the deployment bar. In the case of purely electrical tools this is easily accomplished. This can be much more difficult in the case of flow through tools. One or more Kelly cocks and/or check valves are used in the case of a single flow through passage. A Kelly cock is an inline ball or plug valve with tool joint threaded ends. In the case of tools with more than one fluid passage, this problem has not been solved.

The first section of the tool is deployed in a manner identical to that of the direct riser method. Once the tool has been lowered such that the deployment bar is located across the appropriate BOP rams, the rams are closed. Pressure and/or pull tests are generally performed. The riser pressure is bled off and the conveyance method is disconnected from the first tool section above the deployment bar (and Kelly cock(s) if present). This disconnection is either accomplished by disconnecting the riser and lifting it to access the connection area or by using a device called a window to safely access the area. A window is a device that can support axial load at all times, but that has a section of the pressure barrier that can be opened and moved out of the way (generally upward) to gain access to the inside.

A special riser with a sliding section is also available that allows the lower section of the riser to be slid upward onto the upper section, thus exposing the connection area without moving the conveyance method. However, this telescoping riser does not carry axial load when it is sliding and it can only contain pressure in its fully extended state. Once the conveyance method is disconnected, any number of additional tool sections may be attached to the conveyance method, installed in the riser, attached to the top of the deployment bar, be deployed, and hung off in the BOPs. The number of tool sections is limited only by the gripping capacity of the BOP (very high), the tensile strength of the deployment bar, and the lifting capacity of the conveyance method (generally the limiting factor).

At this point, a different conveyance method may be used to actually carry the tool down into the well. This is often done in the case of coiled tubing tools as the connection and disconnection step is quite challenging when using coiled tubing. The reasons for this are the residual bend in the coiled tubing pushing the end of the coiled tubing off center, the stiffness of the coiled tubing, and the very high push and pull forces available. Once the tool sections are all in place, the final tool section is attached to the final conveyance method, install in a (usually much shorter) riser, and connected to the deployment bar. Pressure and/or pull tests are generally performed. Once this is done, the riser is equalized with the well head pressure, the BOPs that are holding the deployment bar are opened, and the tool is run down into the well.

This method suffers from many faults. The deployment bars add significant length to the tool string (from 3 feet each to 12 feet each). Many tools are not suitable for deployment bars or special bars have to be designed. Many tools can only be split in certain places leading to long tool sections that have to be deployed. Some tools cannot be used with a Kelly cock. In order for a Kelly cock to be used, the next section of tool must provide a complete pressure barrier above the Kelly cock so that it can be opened with the outside of the tool at atmospheric pressure. One key tool that does not meet this test is a perforating gun. Unfired perforating guns generally do not have a high pressure rated barrier between gun sections, but the gun housing is a very good pressure barrier. Also, the detonating means (generally a detonating cord) must be run all the way through the tool and any deployment bars. Once the guns are fired, they do not provide any pressure barrier at all and any pressure barrier that the deployment bars provided has been exploded. This method also has considerable additional personnel risk due to the possibility of ejecting the tool if the correct steps are not followed in the exact sequence.

The final deployment method is generally very similar to the indirect method. However, the key difference is that a special BOP is provided along with a special connection means, called a CIRP connector. The lower ram of the CIRP BOP can grip the bottom part of a CIRP connector and both locate and support the tool string. The upper ram locks the bottom part of the CIRP connector in place and unlatches the connector. The upper part of the CIRP connector (still attached to the conveyance means) is pulled up and two gate valves are closed, sealing off the well bore. Then, another tool section can be installed in the riser. Once it is in place a pressure and/or pull test is generally performed. The riser pressure is equalized with the well head pressure and the gate valves are opened. The next tool section is conveyed down until the CIPR connector on the bottom of it enters the CIRP connector held in the CIRP BOP. The connector is latched, pull and/or push tested, and the remaining CIRP BOP rams are opened. The tool string is lowered further into the well and the process is repeated at the next connector. This method allows perforating guns to be safely deployed and undeployed since it avoids the need for pressure containing pressure at the deployment section (CIRP connector instead of a deployment bar).

A special method similar to deployment is used in snubbing units. A snubbing unit consists of a fixed slip assembly and a moving slip assembly above it. The moving mechanism is generally capable of providing a very large force in both directions and the two slip assemblies are capable of carrying load in both directions. In these units a ram type BOP is attached to the well head and a special type of BOP called an annular BOP is attached above it. An annular BOP can seal on a variable diameter and allow the object it is sealed on to move through it. It can generally also seal on an open hole, though this consumes a significant portion of the life of the element to do so. Also, it can accommodate variations in the diameter of the object moving through it (such as the upsets on drill pipe). A riser may be provided between the two. The very short tool is inserted through the annular (and possibly the BOP). The upper slip assembly is closed on the drill pipe above the tool. The annular is closed, a pressure test is generally performed, and the well head is opened. The moving mechanism moves the drill pipe downward, forcing the drill pipe through the annular against the wellhead pressure. This procedure is known as snubbing. When the moving mechanism has moved as far as possible, the lower slip is set on the drill pipe. The upper slip is opened and moved upward. The process is repeated.

Additional joints of pipe are torqued on as needed. One or more check valves on the bottom of the drill pipe must hold pressure perfectly if the drill pipe is going to be pumped through. If the drill pipe is only being used as a high force conveyance, the bottom of the drill pipe can be plugged or a sub can be used that doesn't have a hole through it. Snubbing units are very dangerous to operate and the risk of having the drill pipe ejected due to an error in procedure is significant. This procedure is not capable of deploying anything besides very short, simple tools. If a multi-section tool were to be deployed this way, it would have to have a buckling load similar to the drill pipe and have a sufficiently smooth outside diameter for the annular to slide over it. Also, it could not have any sort of protrusions, grooves, holes, soft materials, etc that could damage the annular element. These requirements rule all but the most basic tools.

Accordingly a need exists for a deployment system that allows tools to be deployed into a well in a manner that avoids some or all of the problems associated with existing deployment systems.

SUMMARY OF THE INVENTION

In an exemplary embodiment of the present invention a method of deploying a tool into a pressurized well is provided that includes providing the well with a wellhead having a blow out preventer coupled thereto; setting a pressure barrier within the well at a distance below the blow out preventer that is at least as long as the length of the tool to create a pressure chamber between the blow out preventer and the pressure barrier; and opening the blow out preventer to allow for conveyance of the tool into the pressure chamber.

BRIEF DESCRIPTION OF THE DRAWINGS

The exemplary embodiments of the present invention will be better understood by reference to the following detailed description when considered in conjunction with the accompanying drawings wherein.

DETAILED DESCRIPTION OF EMBODIMENTS OF THE INVENTION

In the following sections the object being deployed is a "tool". In the more general case, the object being deployed may consist of one or more types of sections, and the sections may be very long. In addition, in some instances, the deployment device may also provide the conveyance means: it may be the means to move coiled tubing, jointed pipe, wireline, slickline, or an umbilical, any of which may incorporate multiple fluid paths, electrical conductors, and/or fiber optics.

One application of the present invention may be one in which long sections of coiled tubing, umbilicals, jointed pipe, wireline, slickline, etc. are joined together and deployed to optimize some aspect of the operation. Tools may be dispersed through the length of this string. For instance, the system may be used to deploy a tool, a length of coiled tubing, a mud motor to rotate the lower section, and then the remaining length of coiled tubing.

Such a system allows the string to be rotated during coiled tubing drilling; a very valuable contribution. It could also deploy a tool, a length of coiled tubing or umbilical, and then suspend the whole string on a wireline. Lengths of jointed pipe might be added to provide additional weight or tools could be installed to provide special functions.

Figure 1:
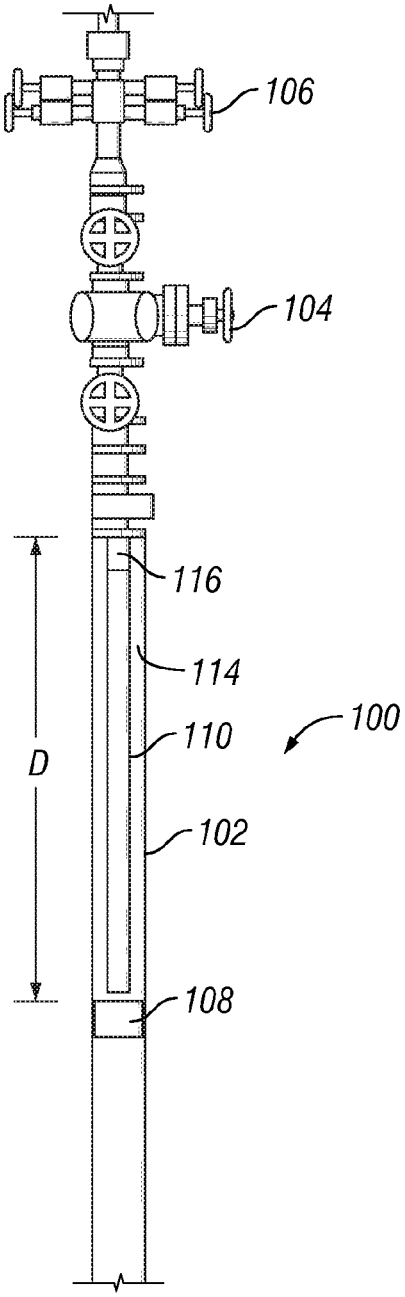
FIG. 1 shows a deployment system according to one embodiment of the present invention.

FIG. 1 shows a deployment system 100 according to one embodiment of the present invention. As shown, the deployment system 100 is used in conjunction with a well 102 having a wellhead 104, with a system of one or more blow out preventers (BOPs) 106 connected thereto. The BOPs 106 prevent pressure inside the well 102 from catastrophically escaping past the wellhead 104 (i.e. a well blow out.) In the embodiment of FIG. 1, a pressure barrier 108 is deployed into a well 102 using a conveyance system (not shown), which may be any one of coiled tubing, jointed pipe, wireline, slickline, or an umbilical, among other appropriate methods.

As shown, the pressure barrier 102 is conveyed past the BOPs 106 and the wellhead 104 and set in a position such that its distance, d, below the wellhead 104 is at least as long as a tool 110 that is desired to be run into the well 102. Once the pressure barrier 108 is set, pressure cannot escape the well 102 past the pressure barrier 108 (i.e., pressure cannot pass from a position below the pressure barrier 108 to a position above the pressure barrier 108 in the embodiment of FIG. 1.) In addition, when the BOPs 106 are closed pressure cannot escape the well 102 past the BOPs 106 (i.e., pressure cannot pass from a position below the BOPs 106 to a position above the BOPs 106 in the embodiment of FIG. 1.) As such, a pressure chamber 114 is created between the BOPs 106 and the pressure barrier 108.

With this pressure chamber 114 created, any pressure in the pressure chamber 114 which is above atmospheric pressure may be bleed off With the pressure chamber 114 at atmospheric pressure, a tool 110 may be safely conveyed into the well 102 by a conveyance system 116, which may be any one of coiled tubing, jointed pipe, wireline, slickline, or an umbilical, among other appropriate devices. Once the tool is positioned below the BOPs 106, the BOPs 106 may be closed to prevent pressure from escaping the well 102. Note that no pressure will escape the well 102 at this time since the pressure barrier 108 is set and the pressure chamber 114 is at atmospheric pressure. However, with the BOPs 106 now closed, the pressure barrier 108 may be opened without allowing pressure to escape the well 102 and therefore, the tool 110 is now safely within the well 102 and may be deployed to any desired depth. Note that by using this method, the method may accommodate both irregularly shaped tools (i.e. a tool that does not have a relatively smooth and a relatively cylindrical outer surface) and extremely long tools, each of which causes problems with prior deployment systems.

In one embodiment, the pressure barrier 108 includes two check valves that create a double barrier. In other embodiments, the pressure barrier 108 may include a bridge plug, a formation isolation valve, a casing hardware anchored plug, a plug with pringle check valve(s), a plug with a concentric plug attached to tool, a freeze plug, or a plug with other types of valve(s), among other appropriate devices. In one embodiment, the pressure barrier 108 may include a packer element, such as an inflatable packer, designed to seal on the well 102. In such an embodiment, the packer element may include a very large inside diameter relative to its outside diameter. In addition, a check valve may be placed below the packer element.

In an embodiment where the pressure barrier 108 is a freeze plug, a conveyance system such as a conduit may be inserted into the well 102 to carry a freezing solution down to a desired distance, d, below the BOPs 106. This conveyance system may include a return line and/or a sleeve to spread out the cooling. The freezing solution may be set up such that it is sprayed into the well 102 and its temperature drops further and/or it provides the material to be frozen. A mist or sheet of fluid can be fed into the well 102 from the surface to provide the freezing material. Once a frozen plug is created, pressure cannot pass above the plug and a tool 110 may be inserted into a pressurized well 102 by opening the BOPs 106, conveying the tool 110 past the BOPs 106, closing the BOPs 106 once the tool 110 is displaced therebelow, and opening the freeze plug by melting the freeze plug with a warm solution or by pumping through the tool 110. The reverse process can extract the tool 110 from the well 102.

Figure 2:
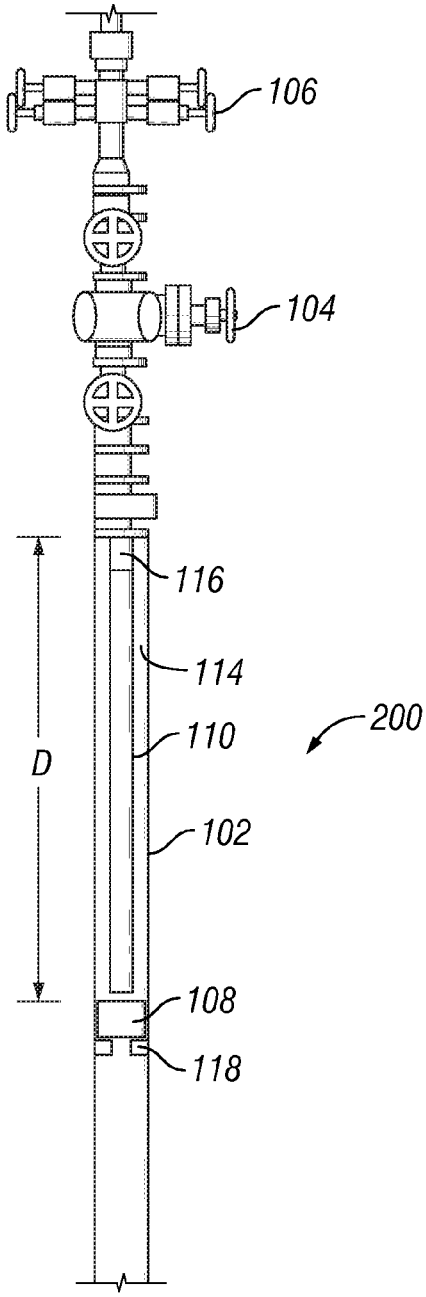
FIG. 2 shows a deployment system according to another embodiment of the present invention.

In the embodiment of FIG. 2, a deployment system 200 similar to that described with respect to FIG. 1 is shown. However, with this embodiment, a seat 118 is installed in the casing or lining of the well 102 to provide an anchor point for attachment of the pressure barrier 108. In such an embodiment, the pressure barrier 108 may include any of the embodiments described above or in a specific embodiment it may include a very large bore check valve that the tool 110 can pass through. Alternatively, the pressure barrier 108 may include a check valve having a very large bore relative to its OD. The flapper is shaped such that when it is open it does not restrict the well 102 more than the ID of the seat 118. The flapper may be shaped like a pipe segment (like a Pringle) or it may be made of multiple segments having generally circular cross section when open. It may also include a feature to prevent the conveyance system 116 and/or the tool 110 from contacting a sealing surface. Further, it may include a feature to prevent tool 110 from catching the flapper(s). It may also incorporate a locking mechanism that requires the presence of a tool to open the check valve. An embodiment using two, three, four, or more leaves may also be used.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

The invention claimed is:

1. A method of deploying a tool into a pressurized and cased well, said method comprising:

providing the pressurized well with a wellhead having a blow out preventer coupled thereto;

conveying a pressure barrier past the blow out preventer and into the pressurized and cased well;

setting the pressure barrier within a casing of the well at a distance below the blow out preventer that is at least as long as the length of the tool to create a pressure chamber between the blow out preventer and the pressure barrier; and opening the blow out preventer to allow for conveyance of the tool into the pressure chamber.

2. The method of claim 1, further comprising bleeding off pressure within the pressure chamber until a pressure with the pressure chamber is approximately equal to atmospheric pressure, and wherein said bleeding off is performed before said opening.

3. The method of claim 1, further comprising closing the blow out preventer once the tool has been conveyed therepast.

4. The method of claim 3, further comprising opening the pressure barrier to allow for conveyance of the tool therepast.

5. The method of claim 1, wherein the pressure barrier comprises a freeze plug.

6. The method of claim 1, further comprising installing a seat in the casing of the well and anchoring the pressure barrier to the seat.

7. The method of claim 1, wherein the pressure barrier comprises a packer.

8. The method of claim 1, wherein the pressure barrier comprises at least one of a bridge plug, a formation isolation valve, an anchored plug, and a check valve.

9. The method of claim 1, wherein the pressure barrier comprises a double barrier.

10. The method of claim 9, wherein the double barrier comprises at least two check valves.

11. The method of claim 1, wherein the tool is conveyed by coiled tubing.

12. The method of claim 1, wherein conveying comprises conveying the pressure barrier into the well with a conveyance system.

13. The method of claim 12, wherein the conveyance system is selected from the group consisting of coiled tubing, jointed pipe, wireline, slickline, umbilical, and a combination thereof.

14. The method of claim 1, further comprising reversing the method to remove the tool and pressure barrier from the well.

15. A method of deploying a tool into a pressurized well comprising:

providing the pressurized well with a wellhead having a blow out preventer coupled thereto;

conveying, by a coiled tubing, a pressure barrier past the blow out preventer and into the pressurized well;

setting the pressure barrier within the well at a distance below the blow out preventer that is at least as long as the length of the tool to create a pressure chamber between the blow out preventer and the pressure barrier;

bleeding off pressure within the pressure chamber until a pressure with the pressure chamber is approximately equal to atmospheric pressure;

opening the blow out preventer while the pressure barrier is in a closed position to allow for conveyance of the tool into the pressure chamber;

closing the blow out preventer once the tool has been conveyed therepast; and opening the pressure barrier while the blow out preventer is in a closed position to allow for conveyance of the tool below the pressure barrier and to a desired depth within the well.

16. The method of claim 15, wherein the pressure barrier comprises a freeze plug.

17. The method of claim 16, wherein said opening of the pressure barrier comprises melting the freeze plug.

18. The method of claim 17, wherein said melting is achieved by one of applying a warm solution to the freeze plug and injecting a fluid into the tool.

19. The method of claim 15, further comprising installing a seat in a casing of the well and anchoring the pressure barrier to the seat.

20. The method of claim 15, wherein the pressure barrier comprises a packer.

21. The method of claim 20, wherein the packer is an inflatable packer.

22. The method of claim 15, wherein the pressure barrier comprises at least one of a bridge plug, a formation isolation valve, an anchored plug, and a check valve.

23. The method of claim 15, wherein the pressure barrier comprises a double barrier.

24. The method of claim 23, wherein the double barrier comprises at least two check valves.

25. The method of claim 15, wherein the tool comprises an irregularly shaped outer surface.

26. The method of claim 15, wherein conveying comprises conveying the pressure barrier into the well with a conveyance system.

27. The method of claim 15, further comprising reversing the method to remove the tool and pressure barrier from the well.

28. A method of deploying a tool into a pressurized well comprising:

providing the well with a wellhead having a blow out preventer coupled thereto;

setting a pressure barrier within the well at a distance below the blow out preventer that is at least as long as the length of the tool to create a pressure chamber between the blow out preventer and the pressure barrier;

opening the blow out preventer to allow for conveyance of the tool into the pressure chamber; and opening the pressure barrier to allow for conveyance of the tool therepast;

wherein the pressure barrier comprises a freeze plug, and wherein said opening of the pressure barrier comprises melting the freeze plug.

29. The method of claim 28, wherein said melting is achieved by one of applying a warm solution to the freeze plug and injecting a fluid into the tool.

* * * * *